US009004501B2

(12) United States Patent
Pokupec

(10) Patent No.: US 9,004,501 B2
(45) Date of Patent: Apr. 14, 2015

(54) ICE SKATE BLADE ASSEMBLY

(71) Applicant: Douglas Pokupec, Hamilton (CA)

(72) Inventor: Douglas Pokupec, Hamilton (CA)

(73) Assignee: Douglas Pokupec, Burlington (CA)

( * ) Notice: Subject to any disclaimer, the term of this patent is extended or adjusted under 35 U.S.C. 154(b) by 0 days.

(21) Appl. No.: 13/887,310

(22) Filed: May 4, 2013

(65) Prior Publication Data

US 2014/0327217 A1 Nov. 6, 2014

(51) Int. Cl.

| | |
|---|---|
| ***A63C 1/00*** | (2006.01) |
| ***A63C 1/32*** | (2006.01) |
| ***A63C 1/30*** | (2006.01) |
| ***A63C 1/36*** | (2006.01) |

(52) U.S. Cl.

CPC . *A63C 1/32* (2013.01); *A63C 1/303* (2013.01); *A63C 1/36* (2013.01)

(58) Field of Classification Search

CPC ..... A63C 1/30; A63C 1/32; A63C 1/34; A63C 1/36; A63C 1/40; A63C 1/303; A63C 1/24; A63C 1/28

USPC ..... 280/841, 11.12, 11.14, 11.15, 11.18, 280/811

See application file for complete search history.

(56) References Cited

U.S. PATENT DOCUMENTS

| | | | | | |
|---|---|---|---|---|---|
| 22,932 | A * | 2/1859 | Brown | 280/11.15 |
| 396,413 | A * | 1/1889 | McQuown | 280/11.15 |
| 1,228,544 | A * | 6/1917 | Falstrem et al. | 280/11.15 |
| 1,249,115 | A * | 12/1917 | Kessler | 280/11.18 |
| 1,702,316 | A * | 2/1929 | Ridgers | 280/11.14 |
| 1,751,692 | A * | 3/1930 | Fruhbeis | 280/11.15 |
| 2,414,967 | A * | 1/1947 | Meyers | 280/11.14 |
| 4,993,725 | A * | 2/1991 | Barnes et al. | 280/11.14 |
| 6,217,036 | B1 * | 4/2001 | Rowledge | 280/11.15 |
| 6,523,835 | B1 * | 2/2003 | Lyden | 280/11.12 |
| 2005/0116379 | A1 * | 6/2005 | Goldsmith et al. | 264/222 |
| 2008/0100008 | A1 * | 5/2008 | Wan | 280/11.18 |
| 2010/0314844 | A1 * | 12/2010 | Spah | 280/11.18 |

* cited by examiner

*Primary Examiner* — John Walters
*Assistant Examiner* — Brian Swenson

(57) ABSTRACT

An ice skate blade assembly for attachment to a footwear comprising a flexible sole includes; an elongated blade comprising an ice engaging edge; the elongated blade and the ice engaging edge comprising a flexible region; the elongated blade and the ice engaging edge flexible to flex in the flexible region; and the elongated blade comprising an upper portion extending opposite the ice engaging edge, the upper portion for attachment of the elongated blade to the flexible sole of the footwear.

19 Claims, 5 Drawing Sheets

ICE SKATE BLADE ASSEMBLY

BACKGROUND

Generally, the present invention relates to an ice skate blade assembly. More particularly, the present invention relates to an ice skate blade assembly attachable to a footwear, for the use in ice skating.

SUMMARY OF THE INVENTION

Embodiments of the present invention provide an ice skate blade assembly for attachment to a footwear comprising a flexible sole.

According to an embodiment of the present invention, an ice skate blade assembly for attachment to a footwear comprising a flexible sole comprises: an elongated blade comprising an ice engaging edge, the elongated blade and the ice engaging edge comprising a flexible region, the elongated blade and the ice engaging edge flexible to flex in the flexible region, and the elongated blade comprising an upper portion extending opposite the ice engaging edge, the upper portion for attachment of the elongated blade to the flexible sole of the footwear.

In one aspect, the ice skate blade assembly is flexible to flex about at least one axis approximately perpendicular to a longitudinal plane of the elongated blade. In one aspect, the ice engaging edge of the elongated blade is one continuous ice engaging edge. In one aspect, the ice skate blade assembly is attachable to the flexible sole of the footwear, the flexible sole comprising a toe area, a ball of the foot area, an arch area, and a heel area, the flexible sole is flexible to flex in at least one of the toe area, the ball of the foot area, the arch area, and the heel area, and wherein the ice skate blade assembly is configured such that when the ice skate blade assembly is attached to the flexible sole of the footwear, the flexible region is substantially below at least one of the toe area, the ball of the foot area, the arch area, and the heel area of the flexible sole. In one aspect, the elongated blade and the ice engaging edge comprise at least one rigid region, the elongated blade and the ice engaging edge is rigid in the rigid region. In one aspect, the ice skate blade assembly is attachable to the flexible sole of the footwear, the flexible sole comprising a toe area, a ball of the foot area, an arch area, and a heel area, the flexible sole is flexible to flex in at least one of the toe area, the ball of the foot area, the arch area, and the heel area, and wherein the ice skate blade assembly is configured such that when the ice skate blade assembly is attached to the flexible sole of the footwear, the rigid region is substantially below at least one of the toe area, the arch area, and the heel area of the flexible sole. In one aspect, the elongated blade comprises a blade thickness from the ice engaging edge to a top edge, the top edge substantially opposite the ice engaging edge, the blade thickness between 0.5 mm and 5 mm. In one aspect, the elongated blade comprises at least one of a plurality of first gripping protrusions, and a plurality of first gripping openings located substantially opposite the ice engaging edge. In one aspect, the ice skate blade assembly comprises at least two of the elongated blade and ice engaging edge substantially parallel to each other and separated by a predetermined distance. In one aspect, the elongated blade and the ice engaging edge is made of at least one of spring metal, metal, plastic, and composite. In one aspect, the elongated blade comprises a plurality of first openings spaced apart, the first openings extending through a width of the elongated blade and up to a top edge of the elongated blade, the top edge opposite the ice engaging edge. In one aspect, the elongated blade comprises a plurality of second openings spaced apart, the second openings extending through a width of the elongated blade and up to the ice engaging edge of the elongated blade. In one aspect, the elongated blade comprises a plurality of third openings spaced apart, the third openings extending through a width of the elongated blade. In one aspect, the elongated blade comprises a blade holder comprising an upper attachable to the flexible sole of the footwear, and a lower connected to the elongated blade, the blade holder for attachment of the elongated blade to the flexible sole of the footwear. In one aspect, the blade holder comprises a flexible portion flexible to flex with the flexible region of the elongated blade. In one aspect, at least a portion of the blade holder is formed as a one piece construction with at least a portion of the flexible sole. In one aspect, the blade holder comprises at least one of a plurality of second gripping protrusions, and a plurality of second gripping openings gripable for a permanent molded attachment of the blade holder to the flexible sole of the footwear.

In another embodiment, an ice skate blade assembly system for ice skating, comprises: providing the ice skate blade assembly and the footwear as described, wherein the footwear is configured to receive the ice skate blade assembly, wherein the ice skate blade assembly is attached to the flexible sole of the footwear, and wherein the elongated blade and the ice engaging edge are flexible for flexing with the flexible sole of the footwear.

In another embodiment, an ice skate blade assembly for attachment to a footwear comprising a flexible sole, the flexible sole comprising a toe area, a ball of the foot area, an arch area, and a heel area, the flexible sole flexible to flex in at least one of the toe area, the ball of the foot area, the arch area, and the heel area of the flexible sole, the ice skate blade assembly comprising: an elongated blade comprising one continuous ice engaging edge, the elongated blade and the ice engaging edge comprising a flexible region, the elongated blade and the ice engaging edge flexible to flex in the flexible region; and the elongated blade comprising an upper portion extending opposite the ice engaging edge, the upper portion for attachment of the elongated blade to the flexible sole of the footwear, wherein the ice skate blade assembly is configured such that when the ice skate blade assembly is attached to the flexible sole of the footwear, the flexible region of the elongated blade and the ice engaging edge is flexible to flex with at least one of the toe area, the ball of the foot area, the arch area, and the heel area of the flexible sole of the footwear.

In another embodiment, an ice skate blade assembly for attachment to a footwear comprising a flexible sole comprises: an elongated blade comprising an ice engaging edge; the elongated blade and the ice engaging edge comprising a flexible region, the elongated blade and the ice engaging edge flexible to flex in the flexible region; the elongated blade and the ice engaging edge comprising a rigid region, the elongated blade and the ice engaging edge rigid in the rigid region; and the elongated blade comprising an upper portion extending opposite the ice engaging edge, the upper portion for attachment of the elongated blade to the flexible sole of the footwear.

DETAILED DESCRIPTION

Figure 1A:
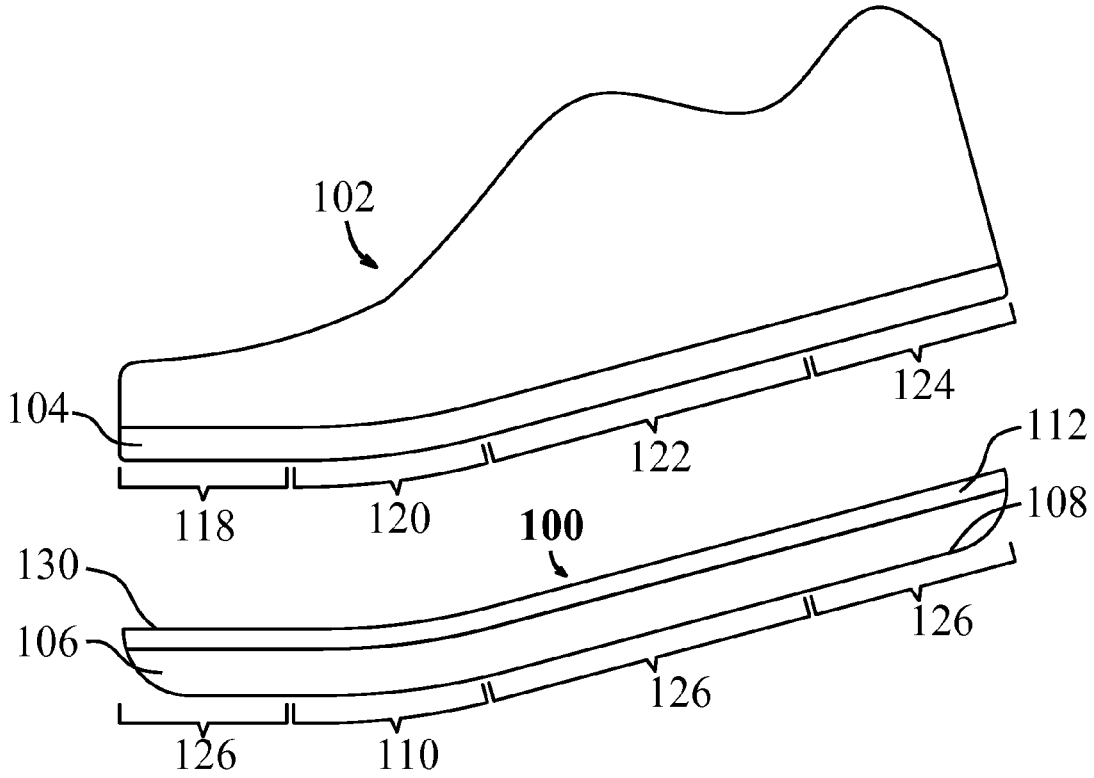
FIG. 1A is a side view of the ice skate blade assembly according to a preferred embodiment.

The term "elongated blade 106" as used throughout this detailed description and in the claims refers to a blade of an ice skate. The elongated blade 106 is typically attached to a footwear 102 to adapt the footwear 102 for skating on an ice surface.

The term "footwear 102" as used throughout this detailed description and in the claims refers to any article of footwear for receiving a human foot. "Footwear 102" may refer to shoes, ice skates, athletic shoes, dress shoes, skateboard shoes, overshoes, sock shoes, slip ons, sandals, and boots but not limited to these.

The terms "toe area 118", "ball of the foot area 120", "arch area 122", and "heel area 124" as used throughout this detailed description and in the claims refers to areas of a flexible sole 104 of the footwear 102. These areas may extend into and include other components of the footwear 102 such as a footwear upper but not limited to this. It should be understood that the following terms as used throughout this detailed description and in the claims, "toe area 118", "ball of the foot area 120", "arch area 122", and "heel area 124" of the footwear 102 are incapable of being exactly defined and located, and that such portions vary from one footwear 102 to another. Thus, the location, the boundaries between, and the size of the toe area 118, the ball of the foot area 120, the arch area 122, and the heel area 124 of the footwear 102 are only rough approximations. These areas are known in the art.

The term "ice surface" as used throughout this detailed description and in the claims refers to any surface used for ice skating such as an ice rink, an indoor ice arena, an outdoor ice arena, a frozen lake, and a frozen pond, but not limited to these. It may also refer to a synthetic ice surface.

Figure 1B:
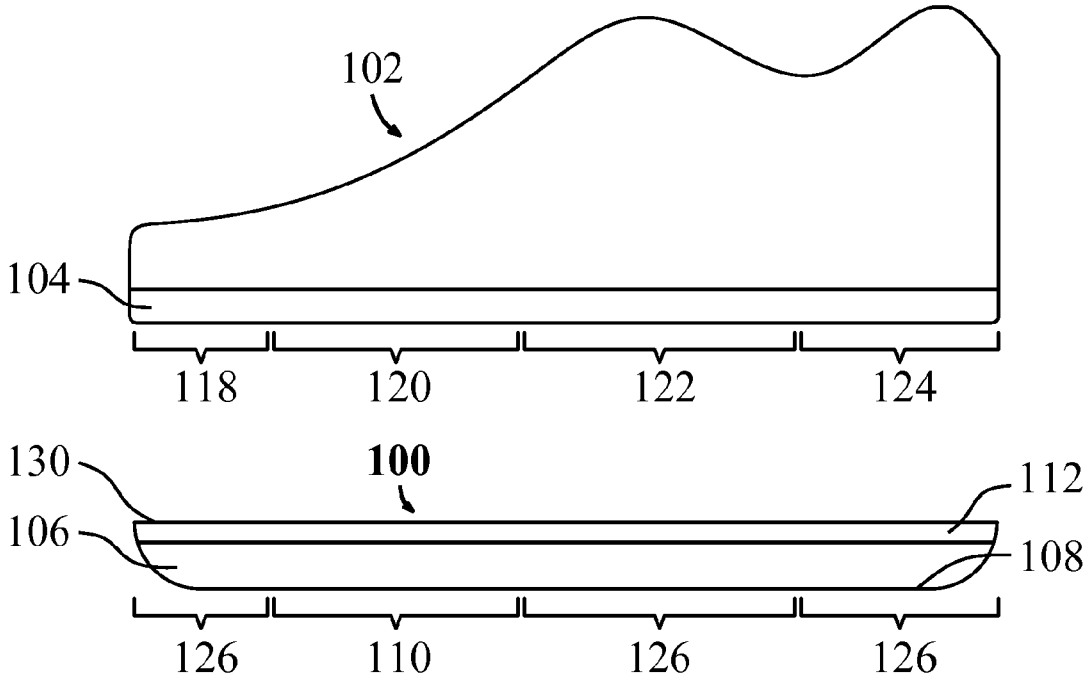
FIG. 1B is a side view of the ice skate blade assembly according to a preferred embodiment.

Referring to FIGS. 1A and 1B, an ice skate blade assembly 100 for attachment to the footwear 102 comprising the flexible sole 104 comprises the elongated blade 106 comprising an ice engaging edge 108. The elongated blade 106 and the ice engaging edge 108 comprise a flexible region 110. The elongated blade 106 comprises an upper portion 112. The elongated blade 106 comprises a top edge 130. The top edge 130 is substantially opposite the ice engaging edge 108. The upper portion 112 extends from the top edge 130 towards the ice engaging edge 108. The ice engaging edge 108 is adaptable for engaging an ice surface for ice skating. The upper portion 112 of the elongated blade 106 is attachable to the flexible sole 104 of the footwear 102. The elongated blade 106 and the ice engaging edge 108 are flexible for flexing in the flexible region 110. In one embodiment, at least a portion of the elongated blade 106 and at least a portion of the ice engaging edge 108 are flexible and for flexing in the flexible region 110. The ice engaging edge 108 located in the flexible region 110 is flexible for flexing repeatedly without fracturing. The flexible region 110 extends from the ice engaging edge 108 towards the top edge 130. The ice skate blade assembly 100 is attachable to the flexible sole 104 of the footwear 102, the flexible sole 104 comprising the toe area 118, the ball of the foot area 120, the arch area 122, and the heel area 124. The flexible sole 104 is flexible for bending in at least one of the toe area 118, the ball of the foot area 120, the arch area 122, and the heel area 124. The ice skate blade assembly is configured such that when the ice skate blade assembly 100 is attached to the flexible sole 104 of the footwear 102, the flexible region 110 is substantially below at least one of the toe area 118, the ball of the foot area 120, the arch area 122, and the heel area 124 of the flexible sole 104.

The footwear 102 is configured to receive a human foot. The footwear 102 is configured to receive the ice skate blade assembly 100. The ice skate blade assembly 100 is attachable to the flexible sole 104 of the footwear 102 to configure the footwear 102 adaptable for ice skating on an ice surface. The ice skate blade assembly 100 is configured such that, when the ice skate blade assembly 100 is attached to the flexible sole 104 of the footwear 102, the flexible sole 104, the elongated blade 106, and the ice engaging edge 108 are flexible for flexing with applied forces of a human foot. The flexible sole 104, the elongated blade 106, and the ice engaging edge 108 are flexible for flexing in at least one of the toe area 118, the ball of the foot area 120, the arch area 122, and the heel area 124 of the flexible sole 104. The flexible sole 104 may comprise any part of the footwear 102 sole, such as the insole, midsole, and outsole but not limited to this. The elongated blade 106 is generally elongated in shape. In an embodiment, the length of the elongated blade 106 comprises a length approximately equal to, greater than, or less than the length of the flexible sole 104 for which it is adaptable to. A sole length is known in the art and is along a longitudinal direction of the sole. The elongated blade 106 is also known in the art as an ice skate blade. An advantage to the embodiments shown is that the elongated blade 106 and the ice engaging edge 108 are flexible for flexing, and adaptable for flexing with the flexible sole 104 of the footwear 102.

According to an embodiment, the elongated blade 106 and the ice engaging edge 108 comprise the flexible region 110 and a rigid region 126. The flexible region 110 is flexible for flexing and bending. The rigid region 126 is rigid. The ice skate blade assembly is configured such that when the ice skate blade assembly 100 is attached to the flexible sole 104 of the footwear 102, the flexible region 110 is substantially below at least one of the toe area 118, the ball of the foot area 120, the arch area 122, and the heel area 124 of the flexible sole 104, and the rigid region 126 is substantially below at least one of the toe area 118, the arch area 122, and the heel area 124 of the flexible sole 104.

According to an embodiment, the ice engaging edge 108 is one continuous ice engaging edge 108.

According to an embodiment, the elongated blade 106 comprising the ice engaging edge 108 is formed as a single part from one material.

According to an embodiment, the elongated blade 106 comprises a toe pick (not shown) which is known in the art. The toe pick comprises serrations located at one end of the blade.

Materials for forming the elongated blade 106 and the ice engaging edge 108 can be selected as desired. Suitable materials include, for example, metal such as spring metal and spring steel. Other suitable materials include, for example, composite and plastics such as ultra high molecular weight plastic and nylon. Suitable materials for the flexible region of the elongated blade 106 and the ice engaging edge 108 include, for example, spring materials and flexible materials that can be repeatedly bent and flexed and return to their original shape without fracturing. Suitable materials for the flexible region include, for example, metal such as spring metal and spring steel. Other suitable materials include, for example, composite and plastics such as ultra high molecular weight plastic and nylon. In one embodiment, the elongated blade 106 and the ice engaging edge 108 comprise a spring material. A spring material returns to its original shape despite significant bending or twisting. The elongated blade 106 and the ice engaging edge 108 may comprise any combination of known materials.

In one embodiment, the elongated blade 106 comprising the ice engaging edge 108 located in at least the flexible region 110 is made of flexible metal, such as spring metal. An example of spring metal includes spring steel. The elongated blade 106 and the ice engaging edge 108 located in at least the flexible region 110 may comprise any material that can be repeatedly bent without fracturing, such as metal, plastic, rubber, and composites but not limited to these. The elongated blade 106 and the ice engaging edge 108 may comprise any combination of the materials mentioned.

In one embodiment, the ice skate blade assembly 100 is detachably attachable to the footwear 102. A detachable attachable ice skate blade assembly 100 configures the footwear 102 adaptable for ice skating, walking and running but not limited to these.

FIG. 1A shows the ice skate blade assembly 100 and the flexible sole 104 of the footwear 102 in a bent position. At least a portion of the ice engaging edge 108 located in the flexible region 110 of the ice skate blade assembly 100 is bent, the bent ice engaging edge 108 having a bend radius. The ice engaging edge 108 adaptable to return to its original shape despite bending or twisting. The ice skate blade assembly 100 is shown not connected to the flexible sole 104 of the footwear 102.

FIG. 1B shows the ice skate blade assembly 100 and the flexible sole 104 of the footwear 102 in a substantially non bent state. It is understood that the footwear 102 with the flexible sole 104 would comprise other parts of the footwear 102 flexible for flexing or bending such as the footwear upper but not limited to this. The ice engaging edge 108 is adaptable for engaging with an ice surface for ice skating. The elongated blade 106 may also be referred to as a runner. This is known in the art.

Figure 2:
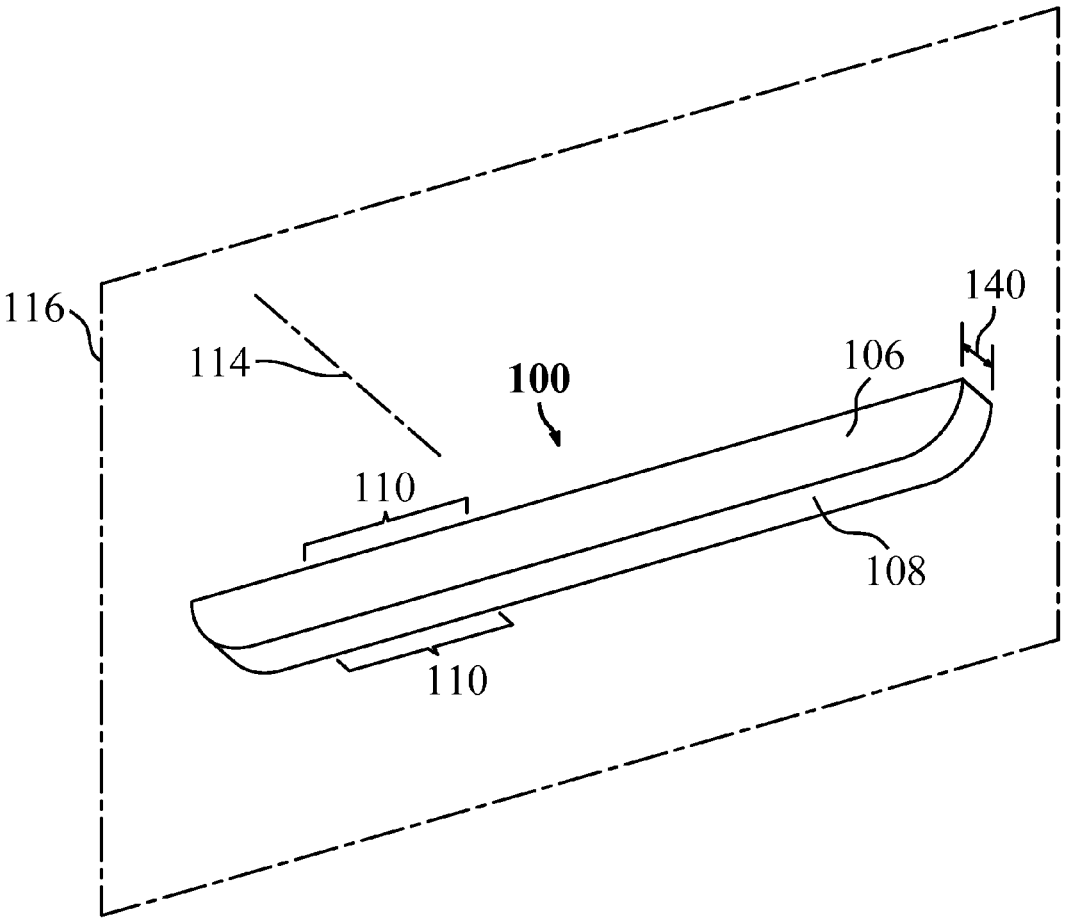
FIG. 2 is a perspective bottom view of the ice skate blade assembly according to a preferred embodiment.

Referring to FIG. 2, according to an embodiment, the ice skate blade assembly 100 comprises the elongated blade 106 and the ice engaging edge 108. The elongated blade 106 and the ice engaging edge 108 comprises the flexible region 110. The ice engaging edge 108 located in the flexible region 110 is readily flexible for bending about at least one axis 114 approximately perpendicular to a longitudinal plane 116 of the elongated blade 106. The ice engaging edge 108 located in the flexible region 110 is bendable about the axis 114 to form the bend radius. Approximately comprises the axis 114 within 1, 5, 10, 20, 30, or forty five degrees from perpendicular to a longitudinal plane 116. The ice engaging edge 108 is approximately perpendicular to the longitudinal plane 116 of the elongated blade 106. The ice engaging edge 108 remains approximately perpendicular to the longitudinal plane 116 throughout the bending motion range of the ice engaging edge 108. Approximately comprises the ice engaging edge 108 within 1, 5, 10, 20, 30, or 45 degrees perpendicular to the longitudinal plane 116. The axis 114 is considered instantaneous and may include a plurality of axis 114. The ice engaging edge 108 is referred to in this embodiment as having a flat profile surface for clarity purposes to define the relationship of the ice engaging edge 108 to the longitudinal plane 116. The ice engaging edge 108 may comprise any profile known in the art such as flat, curved, and round, and any combination herein but not limited to these. A generally flat or concave profile is conventional.

The elongated blade 106 and the ice engaging edge 108 comprise a width 140. In one embodiment, the width 140 of the ice engaging edge 108 is between about 1.5 mm. and 5 mm. Other embodiments include the width 140 of the ice engaging edge 108 greater than 5 mm. In one embodiment, the elongated blade 106 comprises the same width 140 as the ice-engaging edge.

Figure 3A:
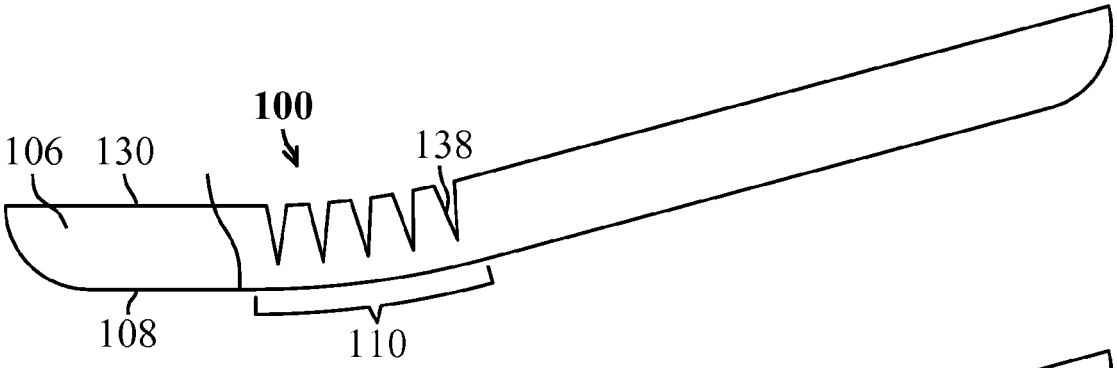
FIG. 3A is a side view of the ice skate blade assembly according to a preferred embodiment.

In FIG. 3A, according to an embodiment, the elongated blade 106 of the ice skate blade assembly 100 comprises a plurality of first openings 138. The first openings 138 are spaced apart from each other and located substantially within the flexible region 110. The first openings 138 extend through the width 140 of the elongated blade 106 and up to the top edge 130 of the elongated blade 106. The top edge 130 is opposite the ice engaging edge 108. The first openings 138 provide the elongated blade 106 and the ice engaging edge 108 flexibility for flexing. The first openings 138 are at least partially openable and closable. In one embodiment, the first openings 138 are in the form of a slit. The first openings 138 may comprise any shape.

Figure 3B:
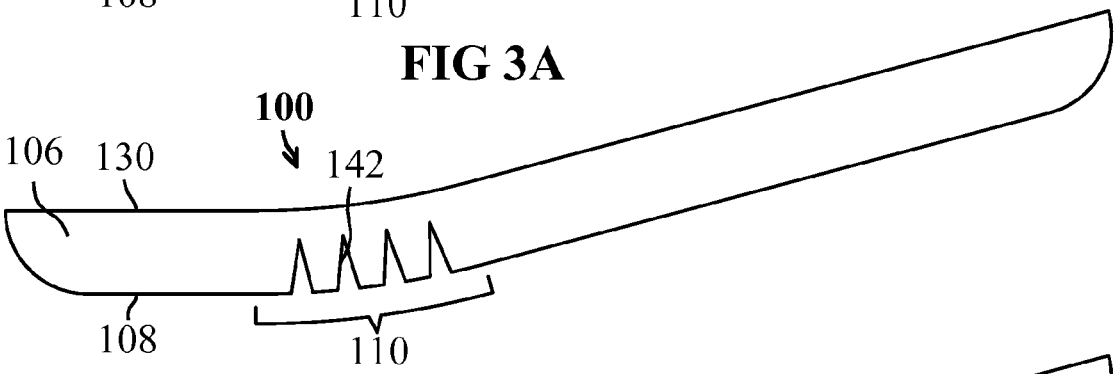
FIG. 3B is a side view of the ice skate blade assembly according to a preferred embodiment.

In FIG. 3B, according to an embodiment, the elongated blade 106 of the ice skate blade assembly 100 comprises a plurality of second openings 142. The second openings 142 are spaced apart from each other and located substantially within the flexible region 110. The second openings 142 extend through the width 140 of the elongated blade 106 and up to the ice engaging edge 108 of the elongated blade 106. The second openings 142 provide at least one of the elongated blade 106 and the ice engaging edge 108 flexibility for flexing. The second openings 142 are at least partially openable and closable. In one embodiment, the second openings 142 are in the form of a slit. The second openings 142 may comprise any shape.

In one embodiment, the elongated blade 106 in the flexible region 110 is substantially flexible and the ice engaging edge 108 is at least partially flexible.

In another embodiment, the elongated blade 106 in the flexible region 110 is substantially flexible and the ice engaging edge 108 is rigid.

Figure 3C:
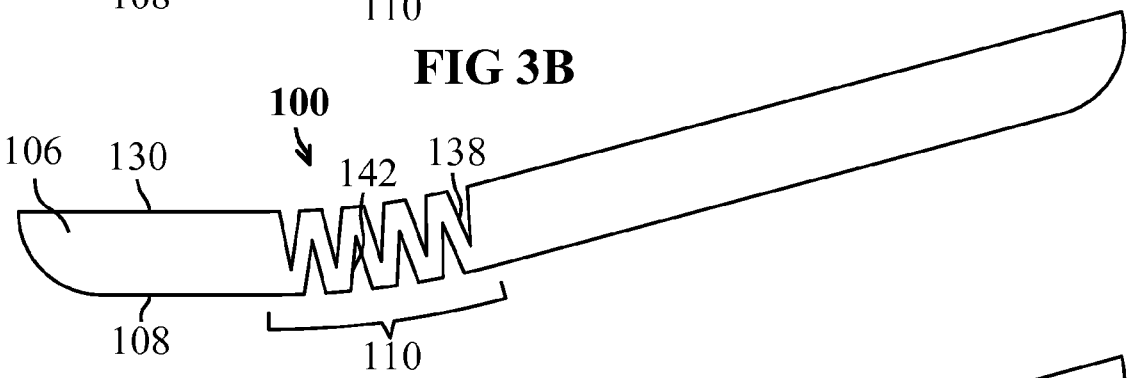
FIG. 3C is a side view of the ice skate blade assembly according to a preferred embodiment.

In FIG. 3C, according to an embodiment, the elongated blade 106 of the ice skate blade assembly 100 comprises a plurality of the first openings 138. The first openings 138 are spaced apart and located substantially within the flexible region 110. The first openings 138 extend through the width 140 of the elongated blade 106 and up to the top edge 130 of the elongated blade 106. The top edge 130 is opposite the ice engaging edge 108. The first openings 138 provide the elongated blade 106 and the ice engaging edge 108 flexibility for flexing. The first openings 138 are at least partially openable and closable. In one embodiment, the first openings 138 are in the form of a slit. The first openings 138 may comprise any shape.

In addition, the elongated blade 106 comprises a plurality of the second openings 142. The second openings 142 are spaced apart from each other and located substantially within the flexible region 110. The second openings 142 are spaced apart from the first openings 138. The second openings 142 extend through the width 140 of the elongated blade 106 and up to the ice engaging edge 108 of the elongated blade 106. The second openings 142 provide at least one of the elongated blade 106 and the ice engaging edge 108 flexibility for flexing. The second openings 142 are at least partially openable and closable. In one embodiment, the second openings 142 are in the form of a slit. The second openings 142 may comprise any shape.

In one embodiment, the elongated blade 106 in the flexible region 110 is substantially flexible and the ice engaging edge 108 is at least partially flexible.

In another embodiment, the elongated blade 106 in the flexible region 110 is substantially flexible and the ice engaging edge 108 is rigid.

Figure 3D:
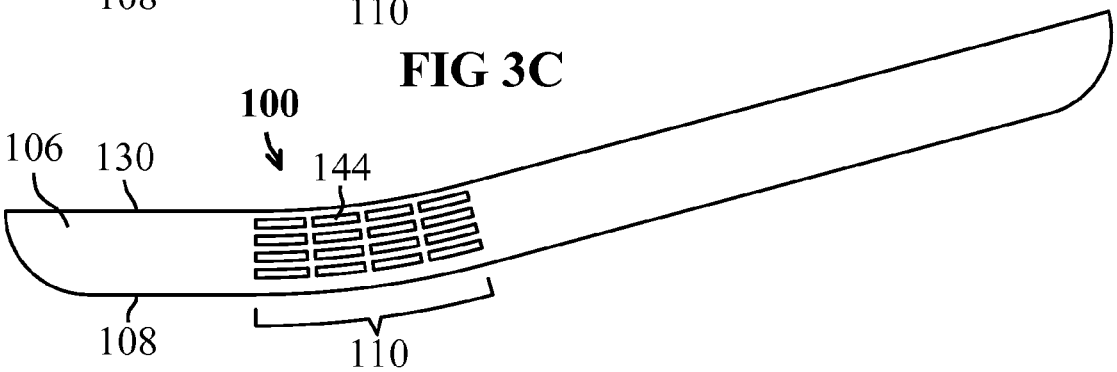
FIG. 3D is a side view of the ice skate blade assembly according to a preferred embodiment.

In FIG. 3D, according to an embodiment, the elongated blade 106 of the ice skate blade assembly 100 comprises a plurality of third openings 144. The third openings 144 are spaced apart from each other and located substantially within the flexible region 110. The third openings 144 extend through the width 140 of the elongated blade 106. The third openings 144 provide the elongated blade 106 and the ice engaging edge 108 flexibility for flexing. In one embodiment, the third openings 144 are at least partially openable and closable. The third openings 144 may comprise any shape.

Figure 4A:
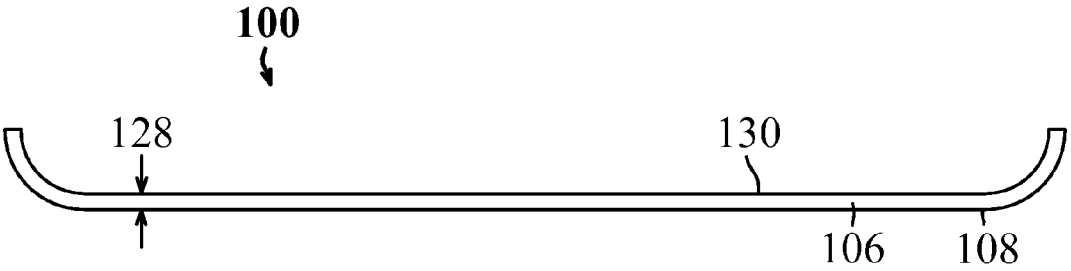
FIG. 4A is a side view of the ice skate blade assembly according to a preferred embodiment.

Referring to FIG. 4A, according to an embodiment, the elongated blade 106 comprises a blade thickness 128. The blade thickness 128 extends from the ice engaging edge 108 of the elongated blade 106 to the top edge 130 of the elongated blade 106. The top edge 130 is substantially opposite the ice engaging edge 108. The top edge 130 and the ice-engaging edge may comprise any cross section profile. At least a portion of the material of the elongated blade 106 located within the blade thickness 128 and within the flexible region 110 is flexible for bending. In one embodiment, the blade thickness 128 is between approximately 0.5 mm and 5 mm.

In one embodiment, the elongated blade 106 comprising the ice engaging edge 108 located in at least the flexible region 110 is made of a spring metal comprising the blade thickness 128 between approximately 0.5 mm and 2 mm.

In another embodiment, the elongated blade 106 comprising the ice engaging edge 108 comprises the blade thickness 128 between approximately 0.5 mm and 30 mm but not limited to this. In one embodiment, the blade thickness 128 is variable. The elongated blade 106 may comprise rigid material extending past the blade thickness 128 in a direction opposite the ice engaging edge 108. A smaller blade thickness 128 is generally more flexible for flexing than a larger blade thickness 128.

Figure 4B:
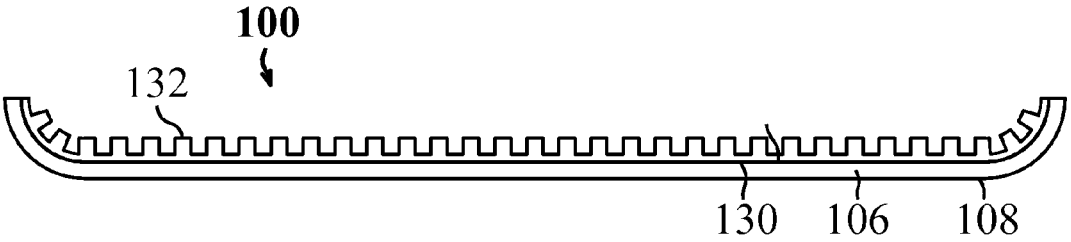
FIG. 4B is a side view of the ice skate blade assembly according to a preferred embodiment.

Referring to FIG. 4B, according to an embodiment, the elongated blade 106 comprises a plurality of first gripping protrusions 132 located substantially opposite the ice engaging edge 108. The first gripping protrusions 132 are securely connected to the top edge 130 of the elongated blade 106. The connection may include a welded connection. The first gripping protrusions 132 comprise protrusions. The first gripping protrusions 132 provide grip for a moldable attachment of the first gripping protrusions 132 to at least one of the flexible sole 104 and a blade holder 146. At least a portion of the elongated blade 106 comprising the ice engaging edge 108 and the first gripping protrusions 132 are flexible for flexing together. In one embodiment, the first gripping protrusions 132 extend across the entire length of the elongated blade 106. In another embodiment, the first gripping protrusions 132 extend across a portion of the length of the elongated blade 106.

In one embodiment, the elongated blade 106 and the first gripping protrusions 132 are both made of metal and welded together.

Figure 4C:
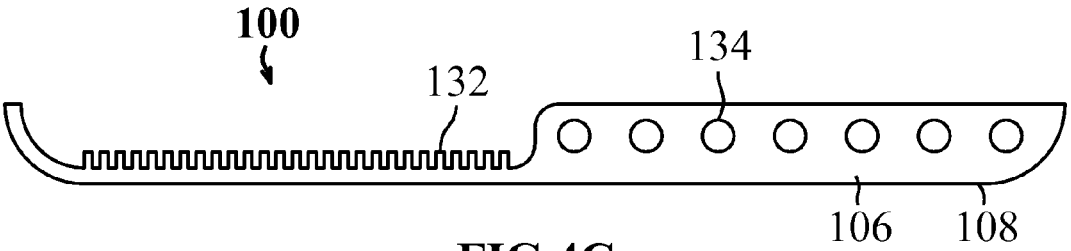
FIG. 4C is a side view of the ice skate blade assembly according to a preferred embodiment.

Referring to FIG. 4C, according to an embodiment, the elongated blade 106 comprises at least one of, a plurality of the first gripping protrusions 132 and a plurality of first gripping openings 134 located substantially opposite the ice engaging edge 108. The first gripping protrusions 132 are formed as a single part with at least a portion of the elongated blade 106. The first gripping protrusions 132 may comprise the first gripping openings 134. The first gripping protrusions 132 and the first gripping openings 134 are gripable to moldable material such as rubber and plastic. The first gripping protrusions 132 and the first gripping openings 134 are gripable for a permanent molded connection of the elongated blade 106 to at least one of the flexible sole 104 and the blade holder 146. The first gripping protrusions 132 and the first gripping openings 134 provide the elongated blade 106 with a secure grip to at least one of the material of the flexible sole 104 of the footwear 102 and the material of the blade holder 146.

Figure 4D:
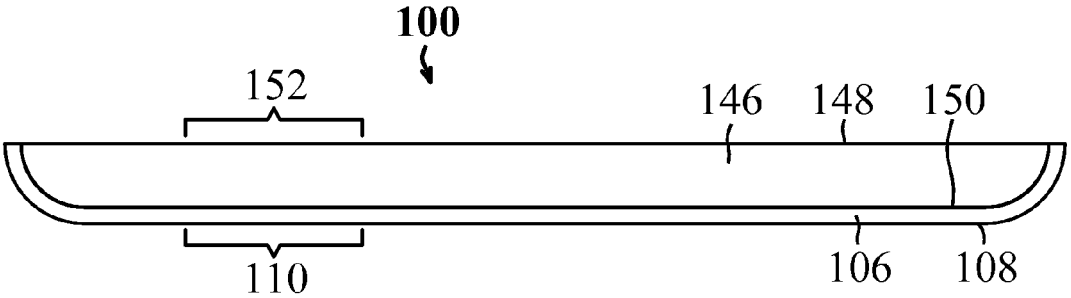
FIG. 4D is a side view of the ice skate blade assembly according to a preferred embodiment.

Referring to FIG. 4D, according to an embodiment, the elongated blade 106 comprises the blade holder 146. The blade holder 146 comprises an upper 148 attachable to the flexible sole 104 of the footwear 102, and a lower 150 connected to the elongated blade 106. The blade holder 146 comprises a flexible portion 152 flexible to flex with the flexible region 110 of the elongated blade 106. The blade holder 146 is for attachment of the elongated blade 106 to the flexible sole 104 of the footwear 102. The blade holder 146 extends from the upper portion 112 of the elongated blade 106 in a direction substantially opposite the ice engaging edge 108. Materials for forming the blade holder can be selected as desired. Suitable materials for the flexible portion of the blade holder include, for example, elastomers such as thermoplastic elastomers. The blade holder 146 located in at least the flexible region 110 may comprise any material that can be repeatedly flexed without fracturing, such as rubber, plastic, metal, and composites but not limited to these. The blade holder 146 may comprise any combination of the materials mentioned. Rubber may refer to any rubber known in the art such as natural rubber, synthetic rubber, moldable rubber, an elastomer, and a thermoplastic elastomer but not limited to these. The blade holder 146 provides flexibility and support to the elongated blade 106.

In one embodiment, the flexible portion 152 is made of flexible rubber. Flexible rubber may include a thermoplastic elastomer.

According to an embodiment, the blade holder 146 extends the entire length of the elongated blade 106 comprising the ice engaging edge 108.

According to an embodiment, at least a portion of the blade holder 146 is formed as a single part with at least a portion of the flexible sole 104.

According to an embodiment, the blade holder 146 is made of moldable rubber molded to a spring steel elongated blade 106 comprising the ice engaging edge 108. The rubber is flexible in the flexible region 110.

According to an embodiment, the blade holder 146 connection to the elongated blade 106 comprises at least one of a molded connection, fasteners, and adhesives.

According to an embodiment, the elongated blade 106 is detachably attachable to the blade holder 146.

Figure 5A:
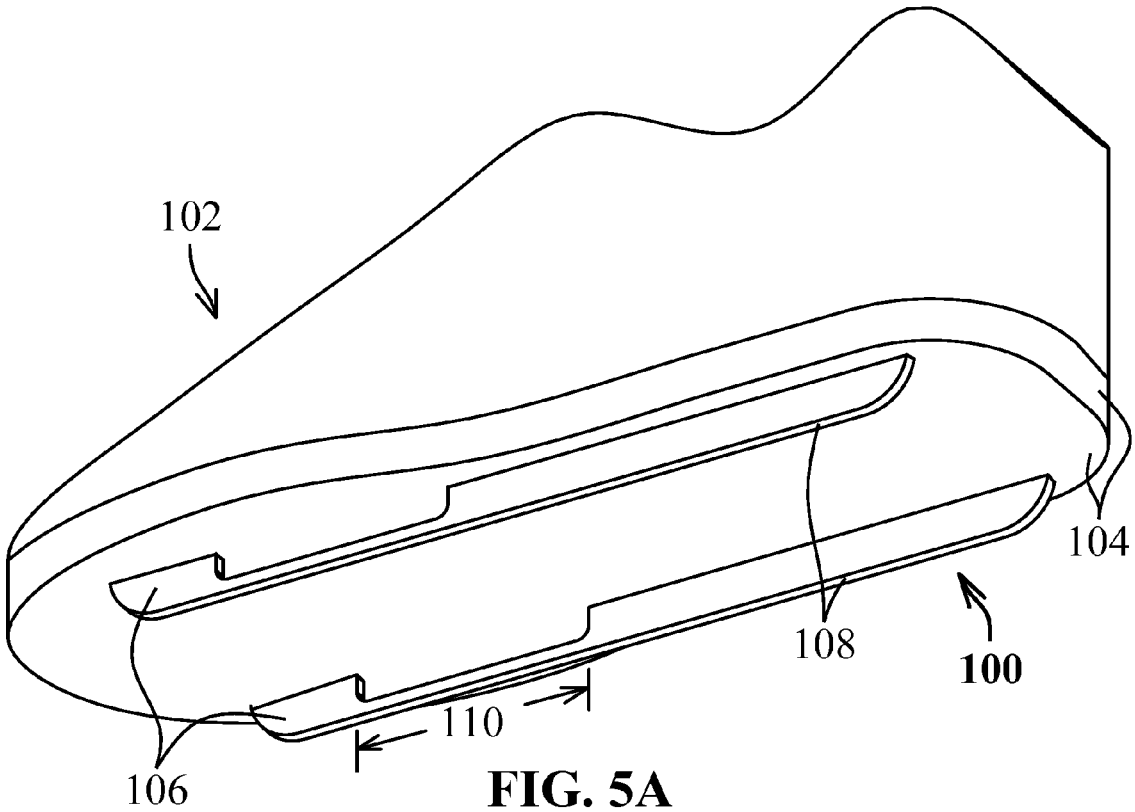
FIG. 5A is a perspective bottom view of the ice skate blade assembly according to a preferred embodiment.

Referring to FIG. 5A, an ice skate blade assembly 100 system for ice skating includes the ice skate blade assembly 100 and the footwear 102. The footwear 102 is configured to receive a human foot. The footwear 102 comprises the flexible sole 104. The flexible sole 104 is flexible for flexing in at least one of the toe area 118, the ball of the foot area 120, the arch area 122, and the heel area 124 of the flexible sole 104 (toe area 118, ball of the foot area 120, arch area 122 and the heel area 124 are shown in FIGS. 1A and 1B). The ice skate blade assembly 100 is attached to the flexible sole 104 of the footwear 102. The flexible sole 104, the elongated blade 106, and the ice engaging edge 108 are flexible for flexing with applied forces of a human foot. The flexible region 110 of the elongated blade 106 and the ice engaging edge 108 are flexible for flexing with at least one of the toe area 118, the ball of the foot area 120, the arch area 122, and the heel area 124 of the flexible sole 104. The flexible sole 104 may comprise any part of a sole, such as the insole, midsole, and outsole but not limited to this. The ice engaging edge 108 is adaptable for engaging an ice surface for ice skating. The ice skate blade assembly 100 system may be used by a wearer for skating on the ice surface. The footwear 102 and the ice skate blade assembly 100 bendable for bending with natural motions of the foot.

Figure 5B:
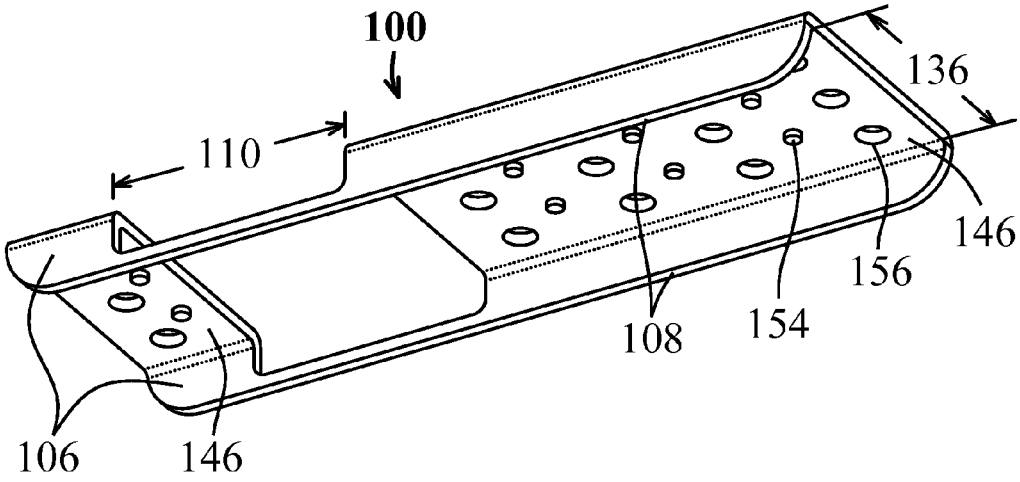
FIG. 5B is a perspective bottom view of the ice skate blade assembly according to a preferred embodiment.

Referring to FIG. 5B, according to an embodiment, the ice skate blade assembly 100 comprises at least two of the elongated blades 106 and ice engaging edges 108 substantially parallel to each other and separated by a predetermined distance 136. The predetermined distance 136 the distance between the parallel ice engaging edges 108. In another embodiment, the predetermined distance 136 is between approximately 10 mm and 100 mm. The elongated blade 106 comprises the blade holder 146. In the embodiment shown, one of the blade holder 146 is connected to two of the elongated blade 106. In another embodiment, each elongated blade 106 comprises at least one of the blade holder 146. The blade holder 146 comprises the upper 148 attachable to the flexible sole 104 of the footwear 102, and the lower 150 connected to the elongated blade 106, the blade holder 146 for attachment of the elongated blade 106 to the flexible sole 104 of the footwear 102. In one embodiment, the blade holder 146 comprises at least one of a plurality of second gripping protrusions 154, and a plurality of second gripping openings 156 gripable for a permanent molded attachment of the blade holder 146 to the flexible sole 104 of the footwear 102.

An ice skate blade assembly 100 comprising two or more elongated blades 106 and ice engaging edge 108*s* are attachable the flexible sole 104 of the footwear 102 to provide the footwear 102 with two or more elongated blades 106 and ice engaging edge 108*s* separated by the predetermined distance 136.

Of course, the various aspects of the embodiments shown in FIGS. 1A to 5B may be mixed and matched as desired, where possible. Further, the present invention is not limited to only those embodiments shown.

I claim:

1. An ice skate blade assembly for attachment to a footwear comprising a flexible sole, the ice skate blade assembly comprising:

a. an elongated blade comprising an ice engaging edge;

b. the elongated blade and the ice engaging edge comprising a flexible region, the elongated blade and the ice engaging edge flexible to flex in the flexible region;

c. the elongated blade comprising an upper portion extending opposite the ice engaging edge, the upper portion for attachment of the elongated blade to the flexible sole of the footwear;

the elongated blade comprises a plurality of first openings spaced apart, the first openings extending through a width of the elongated blade and up to a top edge of the elongated blade, the top edge opposite the ice engaging edge; and the first openings are located substantially within the flexible region, the first openings provide the elongated blade and the ice engaging edge flexibility for flexing, the first openings are at least partially openable and closable.

2. The ice skate blade assembly as claimed in claim 1, wherein the ice engaging edge is flexible to flex about at least one axis approximately perpendicular to a longitudinal plane of the elongated blade.

3. The ice skate blade assembly as claimed in claim 1, wherein the ice engaging edge of the elongated blade is one continuous ice engaging edge.

4. The ice skate blade assembly as claimed in claim 1, wherein the ice skate blade assembly is attachable to the flexible sole of the footwear, the flexible sole comprising a toe area, a ball of the foot area, an arch area, and a heel area, the flexible sole is flexible to flex in at least one of the toe area, the ball of the foot area, the arch area, and the heel area, and wherein the ice skate blade assembly is configured such that when the ice skate blade assembly is attached to the flexible sole of the footwear, the flexible region is substantially below at least one of the toe area, the ball of the foot area, the arch area, and the heel area of the flexible sole.

5. The ice skate blade assembly as claimed in claim 1, wherein the elongated blade and the ice engaging edge comprise at least one rigid region, the elongated blade and the ice engaging edge is rigid in the rigid region.

6. The ice skate blade assembly as claimed in claim 5, wherein the ice skate blade assembly is attachable to the flexible sole of the footwear, the flexible sole comprising a toe area, a ball of the foot area, an arch area, and a heel area, the flexible sole is flexible to flex in at least one of the toe area, the ball of the foot area, the arch area, and the heel area, and wherein the ice skate blade assembly is configured such that when the ice skate blade assembly is attached to the flexible sole of the footwear, the rigid region is substantially below at least one of the toe area, the arch area, and the heel area of the flexible sole.

7. The ice skate blade assembly as claimed in claim 1, wherein the elongated blade comprises a blade thickness from the ice engaging edge to a top edge, the top edge substantially opposite the ice engaging edge, the blade thickness between 0.5 mm and 5 mm.

8. The ice skate blade assembly as claimed in claim 1, wherein the elongated blade comprises at least one of a plurality of first gripping protrusions, and a plurality of first gripping openings located substantially opposite the ice engaging edge.

9. The ice skate blade assembly as claimed in claim 1, wherein the ice skate blade assembly comprises at least two of the elongated blade and ice engaging edge substantially parallel to each other and separated by a predetermined distance.

10. The ice skate blade assembly as claimed in claim 1, wherein the elongated blade and the ice engaging edge is made of at least one of spring metal, metal, plastic, and composite.

11. The ice skate blade assembly as claimed in claim 1, wherein the elongated blade comprises a plurality of second openings spaced apart, the second openings extending through a width of the elongated blade and up to the ice engaging edge of the elongated blade.

12. The ice skate blade assembly as claimed in claim 1, wherein the elongated blade comprises a plurality of third openings spaced apart, the third openings extending through a width of the elongated blade.

13. The ice skate blade assembly as claimed in claim 1, wherein the elongated blade comprises a blade holder comprising an upper attachable to the flexible sole of the footwear, and a lower connected to the elongated blade, the blade holder for attachment of the elongated blade to the flexible sole of the footwear.

14. The ice skate blade assembly as claimed in claim 13, wherein the blade holder comprises a flexible portion flexible to flex with the flexible region of the elongated blade.

15. The ice skate blade assembly as claimed in claim 13, wherein at least a portion of the blade holder is formed as a one piece construction with at least a portion of the flexible sole.

16. The ice skate blade assembly as claimed in claim 13, wherein the blade holder comprises at least one of a plurality of second gripping protrusions, and a plurality of second gripping openings gripable for a permanent molded attachment of the blade holder to the flexible sole of the footwear.

17. An ice skate blade assembly system for ice skating, comprising:

providing the ice skate blade assembly and the footwear as claimed in claim 1;

wherein the footwear is configured to receive the ice skate blade assembly, wherein the ice skate blade assembly is attached to the flexible sole of the footwear, and wherein the elongated blade and ice engaging edge are flexible for flexing with the flexible sole of the footwear.

18. An ice skate blade assembly for attachment to a footwear comprising a flexible sole, the flexible sole comprising a toe area, a ball of the foot area, an arch area, and a heel area, the flexible sole flexible to flex in at least one of the toe area, the ball of the foot area, the arch area, and the heel area of the flexible sole, the ice skate blade assembly comprising:

a. an elongated blade comprising one continuous ice engaging edge;

b. the elongated blade and the ice engaging edge comprising a flexible region, the elongated blade and the ice engaging edge flexible to flex in the flexible region;

c. the elongated blade comprising an upper portion extending opposite the ice engaging edge, the upper portion for attachment of the elongated blade to the flexible sole of the footwear;

the elongated blade comprises a plurality of first openings spaced apart, the first openings extending through a width of the elongated blade and up to a top edge of the elongated blade, the top edge opposite the ice engaging edge;

the first openings are located substantially within the flexible region, the first openings provide the elongated blade and the ice engaging edge flexibility for flexing, the first openings are at least partially openable and closable; and wherein the ice skate blade assembly is configured such that when the ice skate blade assembly is attached to the flexible sole of the footwear, the flexible region of the elongated blade and the ice engaging edge is flexible to flex with at least one of the toe area, the ball of the foot area, the arch area, and the heel area of the flexible sole of the footwear.

19. An ice skate blade assembly for attachment to a footwear comprising a flexible sole, the ice skate blade assembly comprising:

a. an elongated blade comprising an ice engaging edge;

b. the elongated blade and the ice engaging edge comprising a flexible region, the elongated blade and the ice engaging edge flexible to flex in the flexible region;

c. the elongated blade and the ice engaging edge comprising a rigid region, the elongated blade and the ice engaging edge rigid in the rigid region;

d. the elongated blade comprising an upper portion extending opposite the ice engaging edge, the upper portion for attachment of the elongated blade to the flexible sole of the footwear;

the elongated blade comprises a plurality of first openings spaced apart, the first openings extending through a width of the elongated blade and up to a top edge of the elongated blade, the top edge opposite the ice engaging edge; and the first openings are located substantially within the flexible region, the first openings provide the elongated blade and the ice engaging edge flexibility for flexing, the first openings are at least partially openable and closable.

* * * * *